US006246176B1

(12) United States Patent
Fai

(10) Patent No.: US 6,246,176 B1
(45) Date of Patent: Jun. 12, 2001

(54) TIPOVER-SAFE MEANS FOR LAMP

(75) Inventor: Chan K. Fai, Kowloon Bay (HK)

(73) Assignee: Catalina Lighting, Inc.

( * ) Notice: Subject to any disclaimer, the term of this patent is extended or adjusted under 35 U.S.C. 154(b) by 0 days.

(21) Appl. No.: 09/152,480

(22) Filed: Sep. 14, 1998

Related U.S. Application Data

(63) Continuation-in-part of application No. 08/946,164, filed on Oct. 7, 1997, now Pat. No. 6,133,695.

(51) Int. Cl.[7] ..... H05B 37/00

(52) U.S. Cl. ..... 315/119; 315/118; 315/158; 362/410; 362/418; 362/414

(58) Field of Search ..... 315/118, 119, 315/158, 307, DIG. 4; 362/149, 250, 376, 410; 250/214 AL, 214 R; 200/526, DIG. 29, 292, 61.45 R; 361/129, 131

(56) References Cited

U.S. PATENT DOCUMENTS

| | | | | |
|---|---|---|---|---|
| 4,658,129 | * | 4/1987 | Fan | 250/214 R |
| 4,733,324 | * | 3/1988 | George | 361/118 |
| 4,930,054 | * | 5/1990 | Krebs | 362/149 |
| 5,136,127 | * | 8/1992 | Blair | 200/61.52 |
| 5,221,141 | * | 6/1993 | Swanson | 362/250 |
| 5,620,247 | * | 4/1997 | Swanson | 362/250 |
| 5,651,450 | * | 7/1997 | Priesemuth | 200/314 |
| 5,789,869 | * | 8/1998 | Lo et al. | 315/159 |
| 5,801,490 | * | 9/1998 | Fai | 315/118 |
| 5,863,111 | * | 1/1999 | Turner et al. | 362/410 |
| 5,902,037 | * | 5/1999 | Turner et al. | 362/376 |

* cited by examiner

*Primary Examiner*—Haissa Philogene
(74) *Attorney, Agent, or Firm*—Joseph J. Zito; Kendal M. Sheets

(57) ABSTRACT

A safety switch for a lamp is disclosed. The safety switch comprises a pair of electrodes having cylindrical shapes. Each electrode comprises an internal face with a conical cavity therein. The electrodes are arranged so that they are adjacently mounted with an aperture formed between the two conical cavities. In addition, there is a metal ball placed within the conical cavity. The metal ball forms a connection or disconnection of the electrodes. In one embodiment of the invention, the electrodes are horizontally mounted, and when the lamp is displaced from an upright position, the ball rests along the aperture formed between the two electrodes, thereby providing a connection of the electrodes and power and luminescence to the lamp. When the lamp is displaced from the upright position, the ball moves away from the aperture, thereby disconnecting the electrodes and power and luminescence to the lamp. In a second embodiment of the invention, the electrodes are vertically mounted, and when the lamp is in an upright position, the ball rests along the internal conical cavity of the lower electrode, thereby providing power and luminescence to the lamp. When the lamp is displaced from the upright position, the ball moves toward the aperture, thereby connecting the electrodes and disconnecting power and luminescence to the lamp. Accordingly, the safety switch of this invention may be mounted anywhere along the body of the lamp and serves as an effective device for controlling power and luminescence to the lamp when the lamp is in an upright position.

25 Claims, 6 Drawing Sheets

TIPOVER-SAFE MEANS FOR LAMP

This application is a CIP of U.S. application Ser. No. 08/946,164, filed on Oct. 7, 1997, now U.S. Pat. No. 6,133,645.

FIELD OF THE INVENTION

The present invention relates to safety means, and more particularly to a tipover-safe switch and correspondingly to an electronic circuit unit which can cut off the power supply of a lighting circuit to comply with a tipover-safe requirement of new UL Standard (153) effective in Jan. 1999 when the lamp is tipped over.

BACKGROUND OF THE INVENTION

Chinese Patent Application No. 97120142.0 (US pending application Ser. No. 08/872,416) disclosed a fire-safe Halogen Torchiere Lamp with a grid, a thermal sensor, a photo sensor, an electronic circuitry to provide automatic cut-off function of the power supply when the above sensors sensing a preset value, and a mechanical switch for cutting off the power supply when the lamp is tipped over to a preset angle.

The first disadvantage of the prior art tipover switch is a follows. Since such a mechanical switch is located on the under-side of the base, and must positively contact the floor surface, it is always an offense against any safety law to install a power switch in this location. Besides, if the switch is used directly to cut-off the power supply, since one conductor of the power cord must be cut in such a low position for connecting the switch, then strain relieves must be put on both sides of the switch. The connecting means (which are also very near the floor surface) should be insulated with water proof grade materials because the floor surface is always splashed with water.

The second disadvantage of prior art mechanical switch is that, even if the above switch is used for cutting off the signal circuit, since the stroke of the mechanic switch plunger has fixed value, one design can not be used for all lamps. For example, even if the switch is located in the center of the base, if the base diameter is changed, since the stroke of the switch plunger is a constant, the tipover angle will change the accordingly.

The third disadvantage is that, if the torchicere lamp equipped with a prior art switch is successively pushed-pulled by a child to cause the switch to turn ON and OFF successively in a very short time period, the switch will break down at once. The reason is that the majority of the switches are designed to turn ON and OFF less than 50 times in one hour, not in one minute. Accordingly, it always causes trouble in manufacturing a new torchiere lamp or to reform an old torchiere lamp for complying with the tipover-safe requirement of new UL-153 with a prior art tipover-safe switch.

SUMMARY OF THE INVENTION

In view of the deficiencies of the circuit construction of the prior art tipover switch, it is thus a main object of the present invention to provide a safety means wherein the improved safety switch can be activated while the lamp is tipped over, regardless of the position of the switch itself at any portion of the lamp.

It is a further object of the present invention to provide a safety means wherein the electronic circuit unit not only increases the safety of the lamp fixture but also avoids reducing the life of the lamp fixture as it is successively pushed-pulled.

It is an object of the present invention to provide an improved safety means wherein the improved safety switch an be activated while the lamp is being tipped over wherever the switch itself is provided at any portion of the lamp.

It is a further object of the present invention to provide a safety means wherein an electronic circuit unit can automatically cut-off the power supply of a lamp while the lamp is being tipped over.

According to the present invention, a tipover-safe switch for a lamp is provided, wherein the switch comprises a lower conical cavity electrode with a tapered face, an upper cylindrical cup electrode with an internal wall, both of which having equal diameters and being placed with a spacing in a vertical direction, and a metal ball there between acting as a connecting means to cause the two electrodes to be connected or disconnected.

The present invention provides an electronic circuit unit for the above tipover-safe switch which comprises a step-down unit, a rectifying unit and a regulation unit, wherein the electronic circuit unit further comprises a transistor; a tipover-safe circuit unit, the two contact terminals of the tipover-safe switch being connected with the regulation unit and a base of the transistor after being connected in series with a resistor, respectively; and a relay for acting as an electronic switch in accordance with an ON/OFF signal from the tipover-safe switch, a coil of the relay being connected in series with a collector circuit of the transistor and a relay normally-closed contact being connected in series with the lighting lamp.

The present invention further provides a tipover-safe switch for a torchiere lamp wherein it includes two conical cavity electrodes, each of the two electrodes having a taper face, being placed with a spacing in a horizontal direction, which the external form of the two electrodes being the same each other, and a metal ball there between acting as a connecting means to cause the two electrodes to be connected or disconnected.

The present invention provides an electronic circuit unit for a tipover-safe switch, which includes a high-powered thyristor acting as an electronic switch, wherein the tipover-safe switch is connected in series with a low-power thyristor crossing over between the power supply and the base of the high-power thyristor.

BRIEF DESCRIPTION OF THE DRAWINGS

The present invention will become more apparent as the disclosure of the present invention is made with reference to the accompanying drawings wherein.

DETAILED DESCRIPTION OF PREFERRED EMBODIMENTS

Figures 1, 1A:
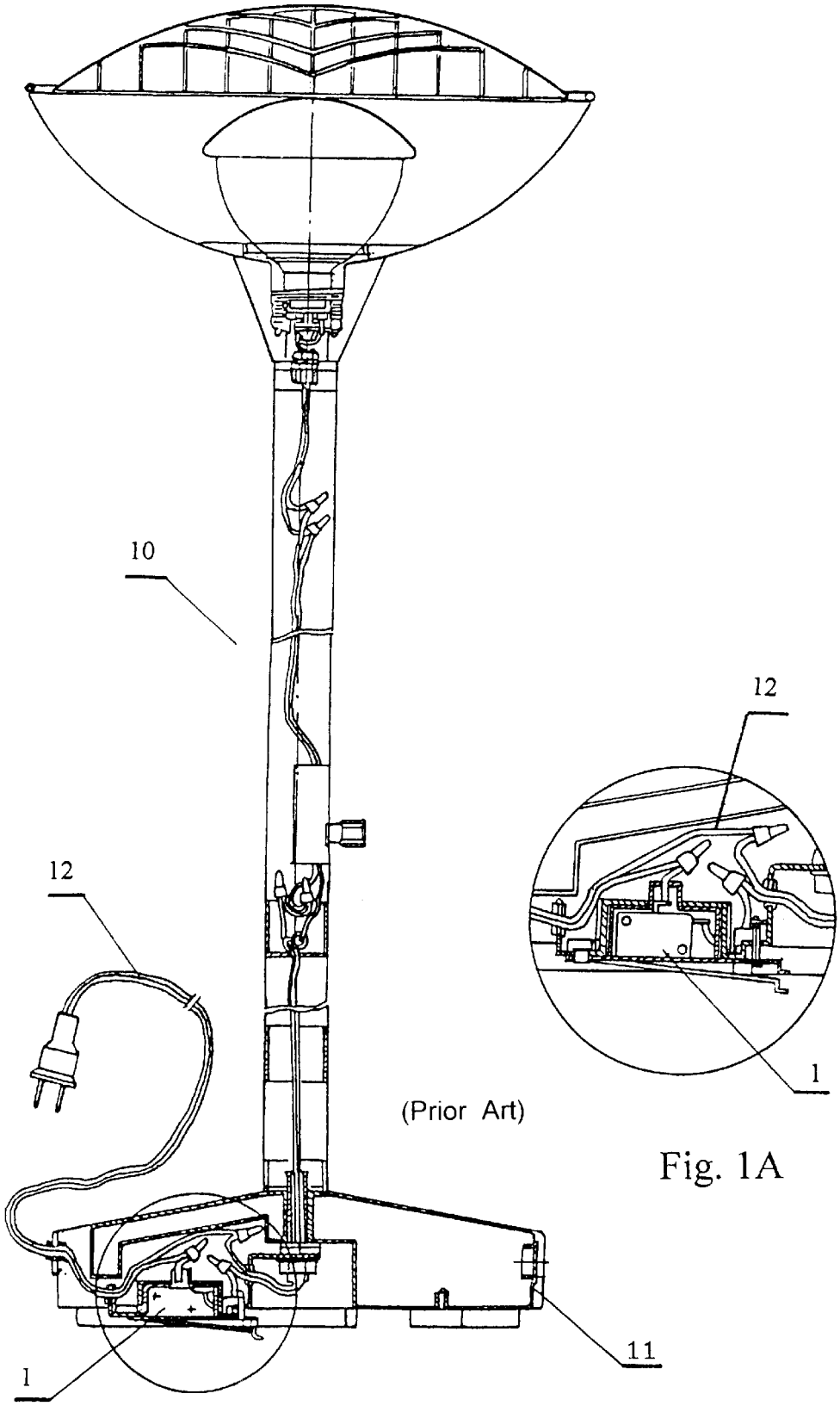
FIG. 1 is a sectional view of the torchiere lamp being provided with a prior art tipover-safe switch which is used for directly cutting off power supply when the lamp is tipped over.
FIG. 1A is an enlarged sectional view of the prior art tipover-safe switch as shown in FIG. 1.
Figure 2:
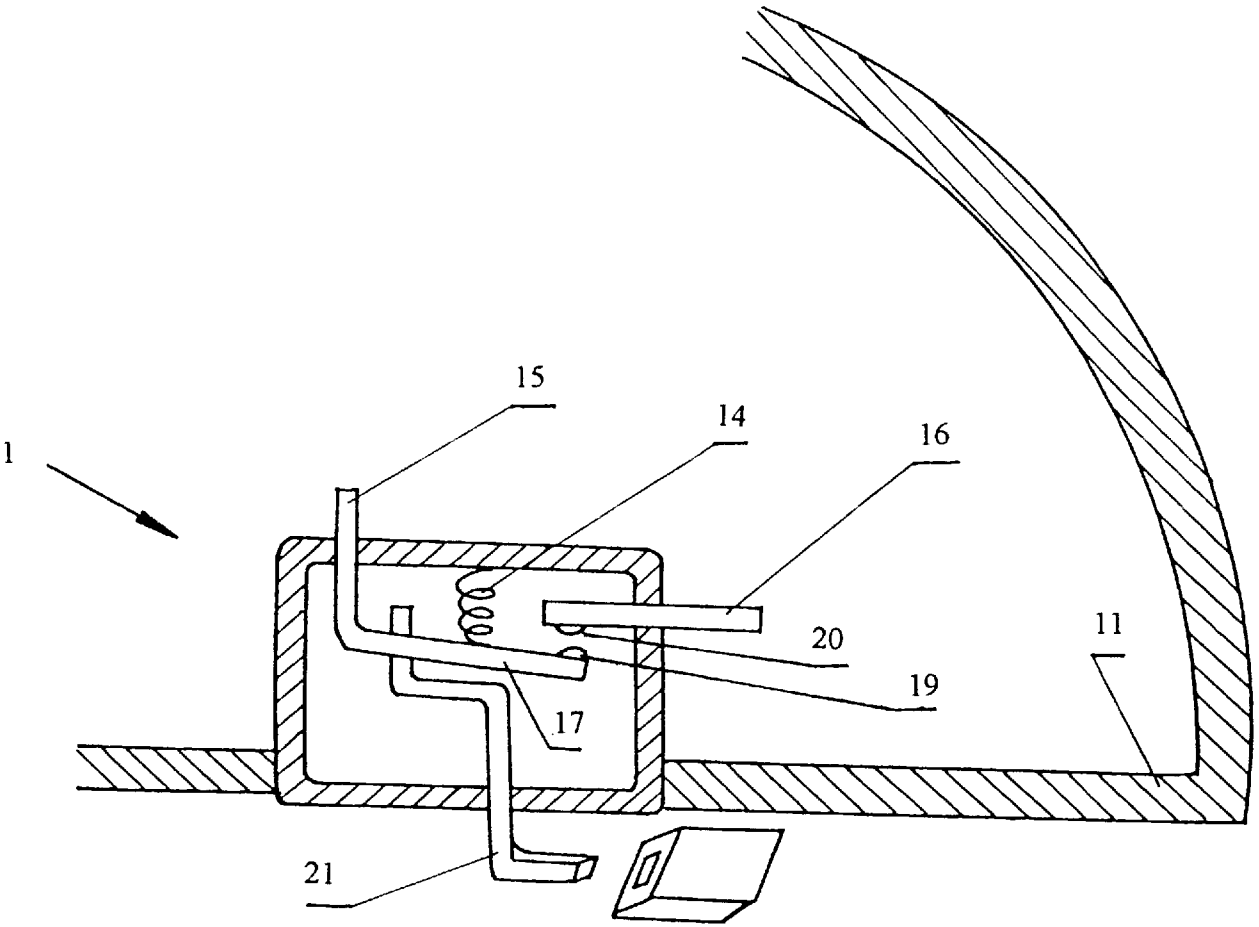
Fig. 2 (Prior Art)
FIG. 2 is an enlarged detail view of the tipover-safe switch as shown in FIG. 1.
Figure 2B:
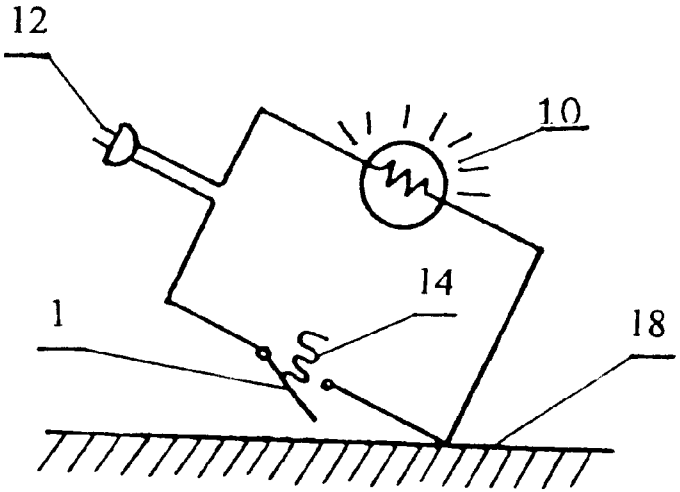
Fig. 2B (Prior Art)
FIG. 2B is a diagrammatic view illustrating the circuit of the lamp and the tipover-safe switch when the torchiere lamp is in a tipped over position.
Figure 2A:
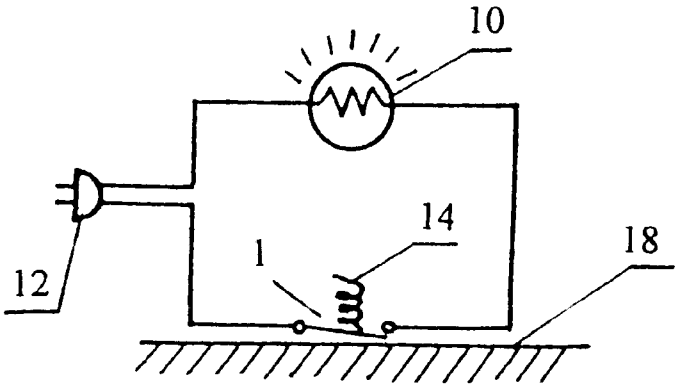
Fig. 2A (Prior Art)
FIG. 2A is a diagrammatic view illustrating the circuit of the lamp and the tipover-safe switch when the torchiere lamp is in an upright position.

As shown in FIGS. 1 and 1A, a prior art tipover-safe switch 1 directly connected with the incoming power cord 12 is installed on under side of a base 11 of a halogen torchiere lamp 10. The structural diagram of the tipover-safe switch 1 is shown in FIG. 2, The switch 1 is a normally open switch with a lever arm 21 which is biased by a spring 14 to have the contacts 19 and 20 of the switch 1 separated from each other. When the lamp is in an upright position with, the base 11 of the lamp resting on the surface 18 of a rigid body, the lever arm 21 will move up as it being forced up by the surface 18. The movement of the lever arm in an upward direction causes the contact arm 17 to move in an upward direction as well, thereby compressing the biasing spring 14 and closing the contacts 19 and 20, so that the lamp will be ON as shown in FIG. 2A. When the lamp is positioned at a certain angle, the contact arm 17 is biased downwardly by the spring 14 to open the contacts 19 and 20 causing the switch 1 to be in a normally open state, so that the lamp is OFF, as shown in FIG. 2B. At such time as the lamp returns to an upright position, it will be ON. It is obvious that in order to install the prior art tipover-safe switch at the under side of base 11, it is necessary for the lamp 10 to be provided with an additional bracket, levels and springs etc. Though the stroke of the switch 1 is constant, the critical angle for the switch 1 being operated will be different, in practice, depending on the position in which the switch 1 is installed and the direction to which the lamp is inclined. Accordingly, proper operation of the switch 1 is dependent upon proper installation of the switch in combination with positioning of the lamp.

When a cup of water is unintentionally splashed on the floor, the lamp and switch illustrated in FIG. 1 will be impregnated immediately. In addition, since the stroke of the switch is a constant, the same switch installed in lamps having different base diameters will get different critical angles for disconnection of the switch. Furthermore, to install the switch in a base will cause the weighting material to become uneven, thus reducing the stability of the torchiere lamp. This may also contribute to causing the lamp to have different tipover angles in different directions. Finally, such a switch can not bear successive ON/OFF operations in a short period since a normal switch can only pass ON/OFF test per the frequency of 50 times in one hour. Accordingly, there are several disadvantages associated with the prior art switch 1 illustrated in FIGS. 1, 1A, 2, 2A and 2B.

Figure 3:
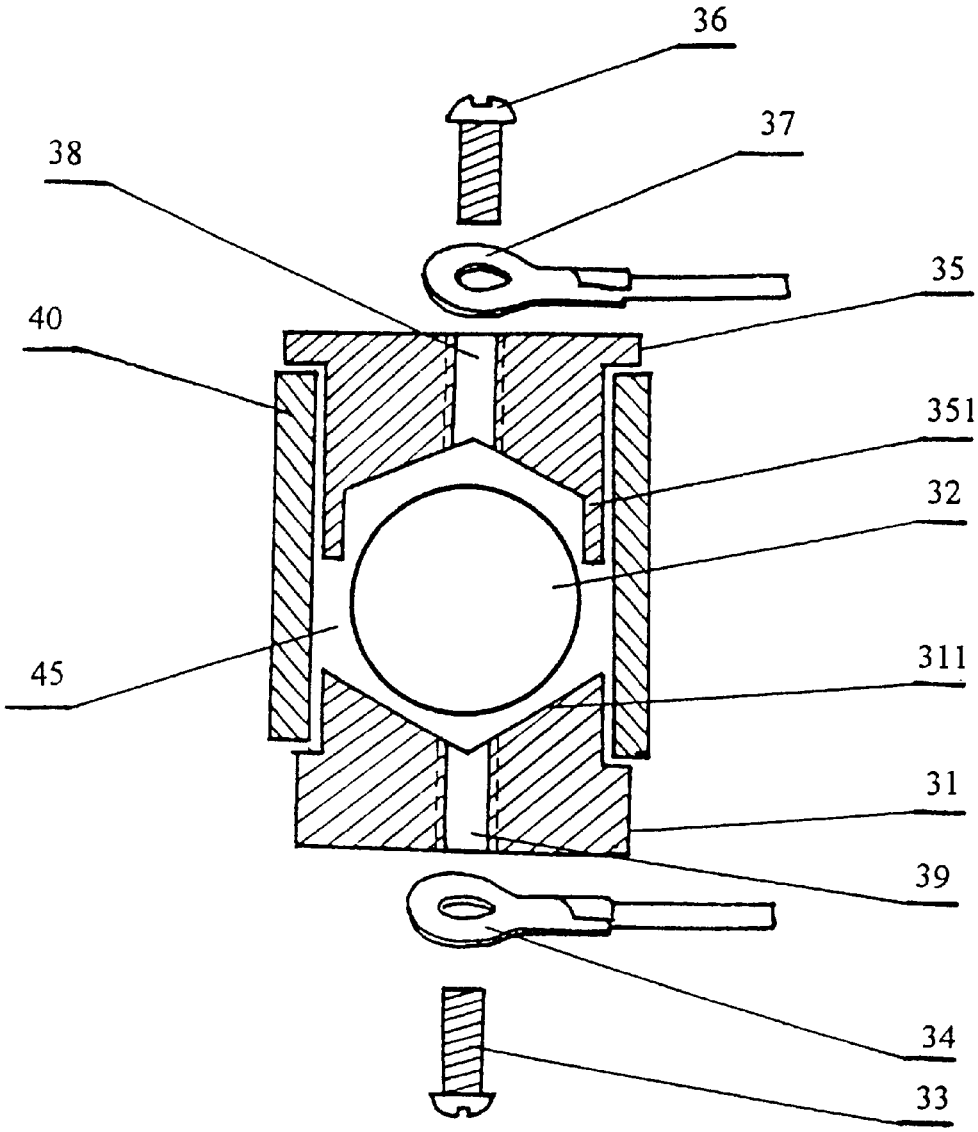
FIG. 3 is a sectional view of a tipover-safe switch of the present invention showing all components used to form the switch.

Now referring to FIG. 3, is a sectional view of the tipover-safety switch 1 of the present invention. A lower conical cavity electrode 31 with a taper face and an upper cylindrical cup electrode 35 with a cylindrical internal wall, both of which have equal diameters, are placed with a spacing 45 there between in a vertical direction. The lower conical electrode 31 comprised of commutator brass has a conical cavity top profile 311 for receiving a metal ball 32 and an axial screw hole 39 for receiving a terminal screw 33 with a connecting ring 34. The upper cylindrical cup electrode 35 comprised of electrode brass has a cylindrical wall 351 of which the diameter is slightly larger than that of the metal ball 32 and an axial screw hole 38 for receiving a terminal screw 36 with a connecting ring 37. A plastic sleeve 40 tightly encloses the lower electrode 31 and the upper electrode 35 in position to form a whole assembly.

In a preferred embodiment of the invention, the angle between the conical cavity top profile 311 and the horizon is 20°. The cone angle of the top profile 311 is in excess of 120° of cone angle of a standard twist-drill. Therefore, any twist-drill can be ground with 140° cone angle for manufacturing the lower brass electrode 31 in a single drilling process.

Figure 4:
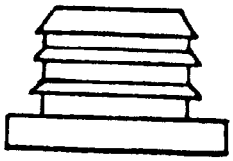
FIG. 4 is an optional contour of the conical cavity electrode.

For securing the assembly, contours of both electrodes can be made as shown in FIG. 4. Thus, once tight-fitted, the plastic sleeve will never depart from both electrodes 31, 35, The metal ball 32 is preferably comprised of the same material as the electrodes, and more specifically is especially preferred that the lower electrode 31 be comprised of the same material as that of the metal ball 32. For example, if the ball 32 is comprised of a steel material in order to resist corrosion caused by electrochemical reaction, it is preferable to plate it with the same material as the lower electrode 31 or to plate it with chrome.

A detailed description of the electro mechanical elements associated with the preferred embodiment of the invention are herein provided in detail together with a comparison to the switch 1 in the prior art. When the tipover-safety switch 1 is displaced to a critical angle in any direction the conical profile becomes parallel to the supporting surface of the lamp. As the angle of displacement of the lamp with respect to the base increases the metal ball 32 naturally rolls outwardly until it is stopped by the cylindrical cup electrode 35. In this position, the metal ball 32 contacts both the conical cavity electrode 31 and the cylindrical cup electrode 35 at the same time, thus connecting the electrodes 31, 35 and disconnecting the power and luminescence of the lamp. Accordingly, the tipover-safety switch of the present invention as, shown in FIG. 3 and described in detail herein remains open in a first mode, providing power and luminescence to the lamp, and maintains a closed position in a second mode thereby disconnecting power and luminescence to the lamp.

Installation of the tipover-safety switch 1 of the present invention in my PCB is relatively. The initial step requires replacement of two connecting ring 34 and 37 with "9" shaped wires and to get their straight portions inserted into prepared holes of PCB and soldered. Then, the terminal screws 33, 36 pass through the "0" shaped portions of the wires, being screwed into two screw holes 39 and 38 of two electrodes 31 and 35. Alternative enclosure devices such as brackets, or equivalent devices providing similar benefits can also be used for installing the switch in any place of the torchiere lamp. Accordingly, one aspect of the tipover safety switch 1 of the present invention is the flexibility to install it on existing PCBs.

Figure 6:
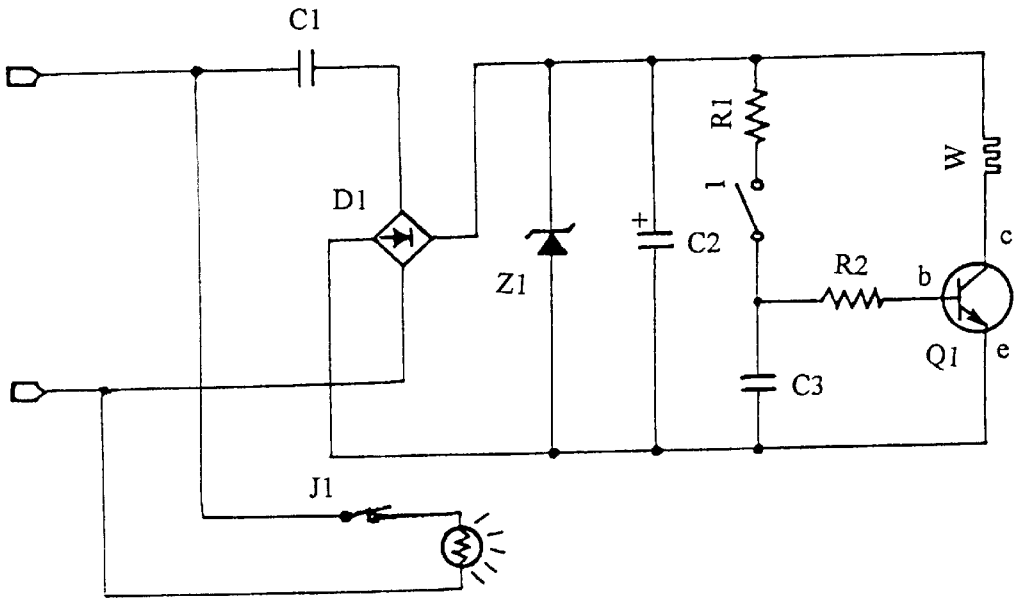
FIG. 6 is a circuit diagram of a preferred embodiment of the present invention, illustrating connection of the tipover-safe switch of this invention into a traditional transistor/relay circuitry.

FIG. 6 shows a preferred embodiment of the electronic circuitry used together with the tipover-safety switch 1 of this invention for opening at the first mode and closing at the second mode if the torchiere lamp has no other electronic device. In the preferred embodiment of the present invention, a step-down capacitor C1 (105/250V) is used in series with the output of an AC power supply (120V,60HZ), and its output then is in connection with the input a rectifier formed by a diode D1 (or by diodes). A Zener diode Z1 is in parallel with the output of the rectifier, and a capacitor C2 acting as a filter-capacitor is in parallel with the diode Z1. The tipover-safety switch 1 of the present invention crosses over between the positive side of the Zener diode Z1 and the base, b, of a transistor Q1 via a resistance R1 (1K 1/4W) and a resistance R2 (1OK 1/4W) respectively. A relay coil W crosses over between the positive side of the Zener diode Z1 and the collector c of the transistor Q1. Meanwhile, a capacitor C3 (220mmF/25V) and the resistance R2 together with the emitter e of the transistor Q1 constitute a 30-second delay circuitry. Furthermore, the relay normally-closed contacter J1 is in series with the lamp to be in connection with the power supply.

In FIG. 6, the output voltage from the AC power supply is initially reduced to a suitable voltage 12V by the step-down capacitor C1 and then rectified by the rectifier D1. The rectified electricity is then stabilized by the Zener diode Z1 and input to the capacitor C2. Once the lamp is tipped over, the tipover-safety switch 1 of the present switch 1 will be ON to have the base b of the transistor Q1 biased. Thus, the current of a collector circuit will cause the relay coil to energize, so the relay normally-closed contacter J1 will act to cut-off power supply to the lamp. In this diagram, R2 and C3 constitute a 30-second delay circuitry once the switch 1 returns to OFF. If the resistance of R2 is changed, time delay will also be changed. This function is used to prevent a child from continuously pushing and/or pulling the lamp to make the lamp flicker between the ON and OFF positions.

Figure 5:
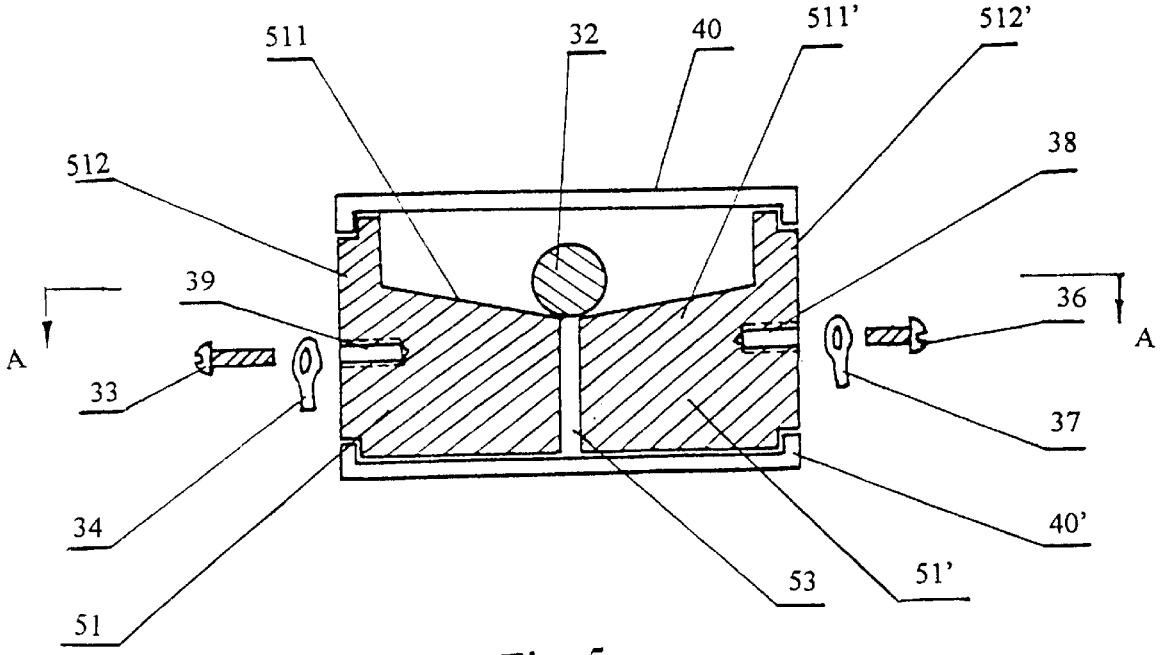
FIG. 5 is a sectional view of an alternative embodiment tipover-safe switch of the present invention, showing all components used to form the switch.
Figure 5A:
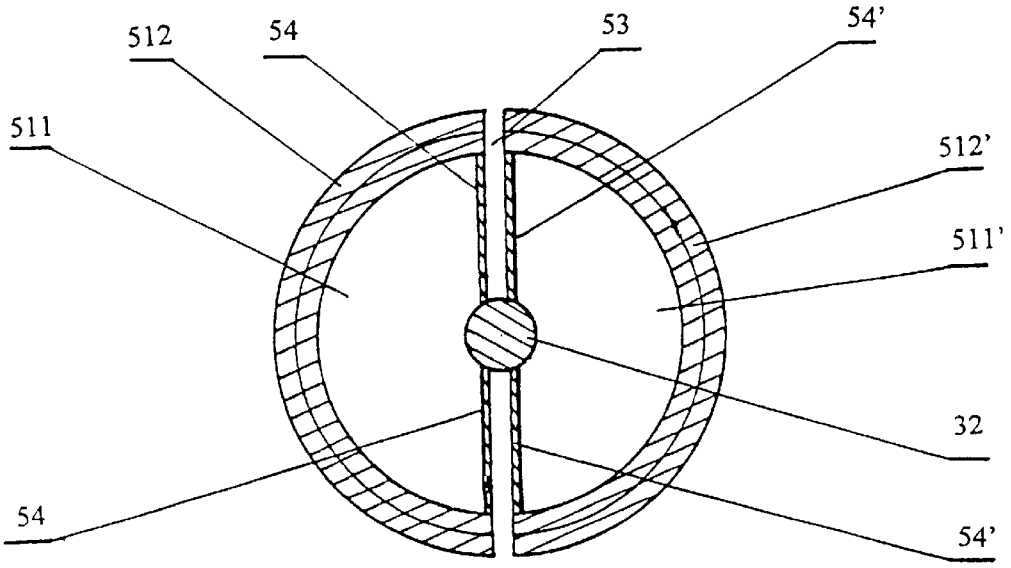
FIG. 5A is a sectional view taken along line A—A of FIG. 5.

FIG. 5 shows another embodiment of the tipover-safety switch according to the present invention. In this embodiment, two electrodes 51 and 51' are placed with a spacing 53 in a horizontal direction. The two electrodes 51 and 51' are shaped into identical semi-cylinders. The tops of the electrodes 51 and 51' are provided with tapered faces 511 and 511', respectively. In addition, the two electrodes 51 and 51' are tightly enclosed in plastic sleeves 40 and 40'. Furthermore, the internal diameter of electrodes 51 and 51' are slightly larger than that of a metal ball 32 so that the metal ball can roll outwardly along the conical cavity portion formed by the semi-cylindrical shapes of the two electrodes. While the lamp is in a normal upright position, the metal ball 32 remains at rest in a bottom level of tapered faces 511 and 511', i.e., in the center of the electrodes thereby providing a connection between the two electrodes 51 and 51'. When the tipover-safety switch is tipped over, or moved from a normal upright position, at a critical angle in any direction, the taper face 511 and 511' in this direction will become parallel to the supporting surface of the lamp. This acute angle of inclination causes the metal ball 32 to roll outwardly until it is stopped by a projection 512 or 512' provided along the circumference of electrodes 51 or 51'. The movement of the metal ball 32 from a position other than at the center of the electrodes 51 and 51' causes the tipover-safety switch of the present invention to turn OFF. In addition to the structure of the electrodes 51 and 51' discussed, it is necessary for the internal edges of electrodes 51 and 51' to be partly provided with insulation portions 54 and 54' to ensure that the switch 1 can be OFF while the metal ball 32 is rolling a certain distance along the spacing 53. This insulation allows the switch 1 of the invention to be OFF effectively while the lamp is tipped over in any direction, as shown in FIG. 5A. Accordingly, the tipover-safety switch of the present embodiment provides for connection of the electrodes at a first mode turning the switch ON and disconnecting the electrodes at a second position turning the switch OFF.

Similar to the preferred embodiment illustrated in FIG. 3, it is preferred that electrodes 51 and 51' be comprised of commutator brass, and the metal ball 32 is preferably comprised of the same material as the electrodes. If steel is the material used for the ball 32, it is preferred to plate it with the same material as electrode 51 and 51' or to plate it with chrome in order to resist corrosion caused by electrochemical reaction.

Figure 7:
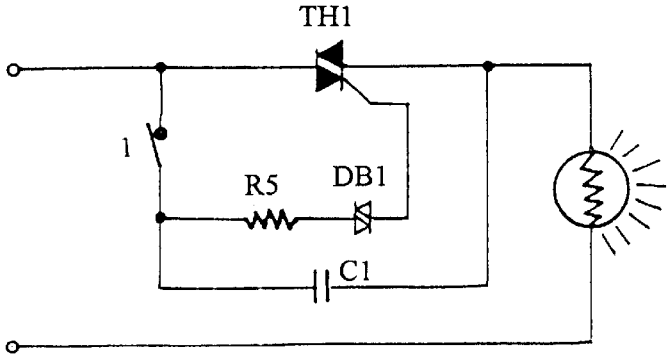
FIG. 7 is a circuit diagram of another preferred embodiment of the present invention, illustrating connection of the tipover-safe switch of this invention into a traditional high-power thyristor unit.

FIG. 7 illustrates an alternative embodiment of the electronic circuitry used together with the tipover-safety switch of the invention for closing the switch at the first mode and disconnecting the switch at the second mode if the torchiere lamp has no other electronic device. In the preferred embodiment of the present invention, a thyristor element TH1 in series with the lamp is provided acting as an electronic switch to control lamp ON/OFF. A tipover-safety switch 1 crosses over between the thyristor element TH1 and the power supply via a resistance R5 and a low-power thyristor DB1 respectively. When the lamp is in a normal position, the voltage will bias the base of the thyristor element TH1 via the closed switch 1 to activate the thyristor TH1 and cause the lamp to turn ON. When the torchiere lamp is tipped over, the tipover-safety switch shown in FIG. 5 will be opened to cut-off the power supply.

The torchiere lamp and its safety elements according to the present invention have outstanding advantages. First, the tipover-safety switch is compact and can be easily installed anyplace within the lamp, such as the stem, the shade, etc., and it is not required to be placed in close proximity to the base and the floor.

Secondly, since now the electronic circuit portion of this tipover-safety switch can be merged into the Printed Circuit Board (PCB) of an electronic dimmer, only a transistor Q1 and some simple components are necessary for completing the electronic circuitry of this invention since any electronic dimmer already comprises the step-down capacitor, the rectifier and the Zener diode. Accordingly, the cost of the tipover-safety switch in accordance with this invention is very low.

Thirdly, all components used in the tipover-safety switch of this invention are very simple and easy to manufacture. For example, electrodes of this invention are designed to be manufactured with brass rod in an automatic lathe, and a plastic sleeve, terminal screw and terminal ring can be bought from the market. Accordingly, the ease of manufacture of the switch contributes to high productivity.

Finally, since now the critical tipover angle is set in the switch by the cone angle of conical cavity electrodes, the tipover-safety switch can be used in any lamp with different base size and stem heights. Accordingly, the switch of the invention can be installed on a variety of lamps and continue to provide the inherent safety benefits associated therewith.

Although the preferred embodiments according to the invention are applied to a torchiere lamp, it is possible that its modifications may be adapted for the other fields where tipover safety may be required, Therefore, it is understood that my modifications or changes can be made by those skilled in the art without departing from the Spirit and scope of the appended Claims of the present invention.

What is claimed is:

1. A tipover-safe switch for a torchiere lamp, comprising:

a lower conical cavity electrode with a tapered face, and an upper cylindrical cup electrode within an internal wall, both of which having equal diameters and being placed with a spacing in a vertical direction, and a metal ball therebetween acting as a connection of said electrodes to cause said two electrodes to be connected or not connected, wherein there is an angle between said tapered face of said conical cavity electrode and a supporting surface of the lamp.

2. A tipover-safe switch for a torchiere lamp according to claim 1, wherein said angle between said tapered face of said conical cavity electrode and the supporting surface of the lamp is not more than 20°.

3. A tipover-safe switch for a torchiere lamp according to claim 1, wherein said cylindrical cup electrode has a cylinder wall, wherein an internal diameter of said cylinder wall is slightly larger than that of said metal ball.

4. A tip over safe switch for a torchiere lamp, comprising:

two conical cavity electrodes, each of said two electrodes having a tapered face, being placed with a spacing therebetween in a horizontal direction, with the external form of the two electrodes having the same shape, and a metal ball therebetween acting as a connection of said electrodes and causing the two electrodes to be connected or not connected, and wherein there is an angle between said tapered face of said conical cavity electrode and a supporting surface of the lamp.

5. A tipover-safe switch for a torchiere lamp according to claim 4, wherein said angle between said tapered face of said conical cavity electrode and the supporting surface is not more than 20°.

6. A tipover safe switch for a torchiere lamp, comprising two conical cavity electrodes, each of said two electrodes having a tapered face, being placed with a spacing therebetween in a horizontal direction with the external form of the two electrodes having the same shape, and a metal ball therebetween acting as a connection of said electrodes and causing the two electrodes to be connected or not connected, wherein said two electrodes are preferably shaped into half-cylinders, and the internal diameter of said conical cavity portion being slightly larger than the diameter of said ball.

7. A tip over safe switch for a torchiere lamp according to claim 6, wherein it is preferable for said half-cylinder electrodes to be provided a projection portion along its circumference.

8. An electronic circuit for a tipover-safe switch as claimed in claim 6, which comprises a step-down unit, a rectifying unit and a regulation unit, wherein the electronic circuit unit comprises:

a transistor;

a tipover-safe circuit unit, the two contact terminals of the tipover-safe switch being connected with the regulation unit and the base of the transistor after being in series with a resistance respectively; and a relay for acting as an electronic switch in accordance with an ON/OFF signal from the tipover-safe switch, a coil of the relay being in series with the collector circuit of the transistor and a relay normally-closed contact being in series with the lamp.

9. An electronic circuit unit according to claim 8, wherein said electronic circuit further comprises:

a delay circuit including a capacitor, a resistance in series with the base of said transistor together with the emitter of said transistor.

10. An electronic circuit unit according to claim 8, wherein said electronic circuit unit can be a part of a dimmer circuit unit.

11. An electronic circuit unit according to claim 8, wherein said electronic circuit unit can be a part independent from a dimmer circuit unit.

12. An electronic circuit unit for a tipover-safe switch as claimed in claim 6, which includes a high-powered thyristor acting as an electronic switch, wherein the tip over safe switch in series with a low-power thyristor crosses over between a power supply and the base of the high-powered thyristor.

13. A safety switch for a lamp, comprising:

a first electrode having a cylindrical shape and a conical cavity on an internal-face;

a second electrode with a cylindrical shape and a conical cavity on an internal face;

said first and second electrodes being mounted in an adjacent manner forming an internal cavity with an aperture formed between said electrodes, a metal ball placed between said electrodes and acting as a connection element of the electrodes;

wherein displacement of the lamp from a normal upright position causes said ball to be moved from a rest position thereby connecting or disconnecting said safety switch.

14. The safety switch of claim 13, wherein said first and second electrodes are horizontally amounted.

15. The safety switch of claim 14, wherein said first and second electrodes further comprising internal diameters greater in size than a diameter of said ball thereby allowing said ball to naturally roll within said internal cavity.

16. The safety switch of claim 15, wherein placement of said lamp in a position perpendicular to a supporting surface causes the metal ball to rest between said first and second electrodes closing said aperture and providing a connection of said electrodes.

17. The safety switch of claim 16, wherein said connection of said electrodes provides power and luminescence to said lamp.

18. The safety switch of claim 15, wherein displacement of said lamp from a position perpendicular to said supporting surface causes the metal ball to roll away from said aperture and toward a wall projection of one of said electrodes opening said aperture and providing a disconnection of said electrodes.

19. The safety switch of claim 18, wherein said disconnection of said electrodes disconnects power and luminescence to said lamp.

20. The safety switch of claim 13, wherein said first and second electrodes are vertically mounted.

21. The safety switch of claim 20, wherein said first and second electrodes further comprising internal diameters greater in size than a diameter of said ball thereby allowing said hall to naturally roll within said internal cavity.

22. The safety switch of claim 21, wherein placement of said lamp in a position perpendicular to a supporting surface causes the metal ball to rest in an internal surface of a lower mounted electrode providing a disconnection of said electrodes.

23. The safety switch of claim 22, wherein said disconnection of said electrodes providing power and luminescence to said lamp.

24. The safety switch of claim 21, wherein displacement of said lamp from a position perpendicular to said supporting surface causes the metal ball to roll away from said lower electrode cavity and toward said aperture and providing a connection of said electrodes.

25. The safety switch of claim 24, wherein said connection of said electrodes providing a disconnection of power and luminescence to said lamp.

* * * * *